US009297101B2

(12) United States Patent
Sakuma

(10) Patent No.: US 9,297,101 B2
(45) Date of Patent: Mar. 29, 2016

(54) PRESSER-FOOT LIFTING AND LOWERING DEVICE FOR SEWING MACHINE

(71) Applicant: Tohru Sakuma, Yamagata (JP)

(72) Inventor: Tohru Sakuma, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 0 days.

(21) Appl. No.: 14/414,929

(22) PCT Filed: Jun. 5, 2013

(86) PCT No.: PCT/JP2013/065564

§ 371 (c)(1),
(2) Date: Jan. 15, 2015

(87) PCT Pub. No.: WO2014/069028

PCT Pub. Date: May 8, 2014

(65) Prior Publication Data

US 2015/0233033 A1 Aug. 20, 2015

(30) Foreign Application Priority Data

Oct. 31, 2012 (JP) ..... 2012-006629

(51) Int. Cl.
*D05B 29/02* (2006.01)
*D05B 29/06* (2006.01)

(52) U.S. Cl.
CPC ..... *D05B 29/02* (2013.01); *D05B 29/06* (2013.01)

(58) Field of Classification Search
CPC ..... D05B 29/00; D05B 29/02; D05B 29/04; D05B 29/06; D05B 29/12; D05B 27/04; D05B 83/00; D05B 9/12; D05B 75/00
USPC ..... 112/237
See application file for complete search history.

(56) References Cited

U.S. PATENT DOCUMENTS 1,134,477 A * 4/1915 Merritt ..... D05B 29/02 112/237
2,544,029 A * 3/1951 Kotzin ..... D05B 29/02 112/236

(Continued)

FOREIGN PATENT DOCUMENTS

JP S4984252 U 7/1974
JP S5236683 Y1 8/1977

(Continued)

*Primary Examiner* — Ismael Izaguirre
(74) *Attorney, Agent, or Firm* — Bacon & Thomas, PLLC

(57) ABSTRACT

When lifting and lowering the presser-foot by either of the manual operation lever and the knee operation lifter, the composition of the lifting and lowering mechanism can be simplified, the number of parts can be reduced and the production can be performed easily. The present invention is provided with a presser bar lifting and lowering mechanism (30) which has: a lifter operating plate which is disposed upon a pedestal (2*a*) which supports an arm (2) upon a bed (3) and which is vertically movable depending on a vertical movement operation of a manual operation lever (31); a pivot rod in which one end is joined to the lifter operating plate via a first joining link; and a presser-foot bar lifting and lowering plate which is joined to a second joining link which is joined to the other end of the pivot rod, and which is joined to the presser-foot bar via a presser bar holder which is fixed to the presser-foot bar. The present invention is provided with a knee lifter mechanism (50) which is disposed upon a right lower end (3*a*) of the bed, which is equipped with a knee operation lifter (51), and which has a knee lifter drive arm which rotates by a swing of the knee operation lifter, wherein the knee lifter drive arm is joined to the lifter operating plate.

3 Claims, 6 Drawing Sheets

(56) References Cited

U.S. PATENT DOCUMENTS

| | | | | | |
|---|---|---|---|---|---|
| 3,540,392 | A | * | 11/1970 | Kaplan | D05B 87/00 112/225 |
| 4,409,914 | A | * | 10/1983 | Sansone | D05B 29/02 112/237 |
| 4,674,424 | A | * | 6/1987 | Shiomi | D05B 29/02 112/237 |
| 6,520,101 | B2 | * | 2/2003 | Sano | D05B 29/02 112/237 |

FOREIGN PATENT DOCUMENTS

| | | | |
|---|---|---|---|
| JP | S6261684 | U | 4/1987 |
| JP | H11207066 | A | 8/1999 |
| JP | 2002239277 | A | 8/2002 |
| JP | 2006204513 | A | 8/2006 |

* cited by examiner

FIG. 3(a)
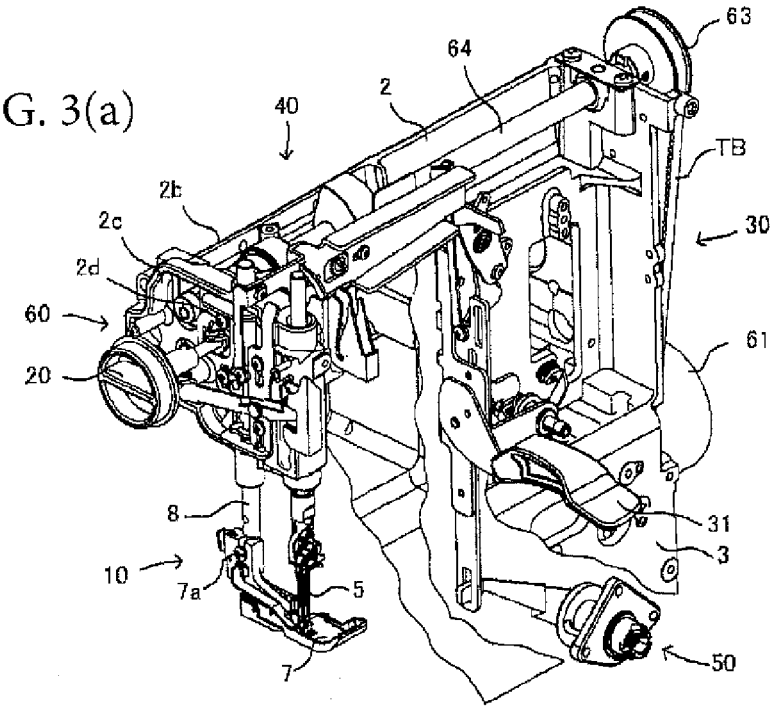
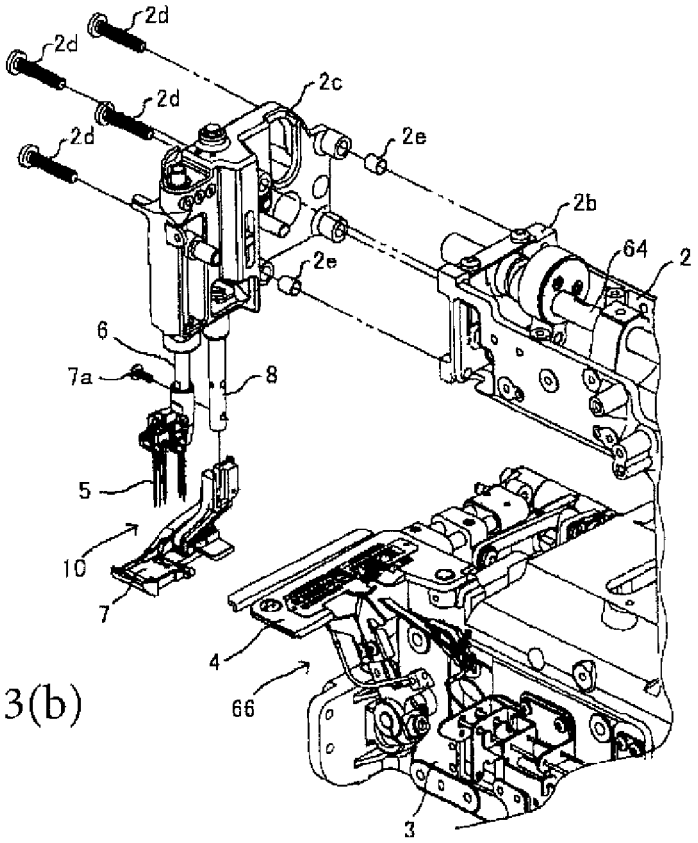
FIG. 3(b)

Pn
Pm
20
14
21
18a
14d
20
20a
22
19
21c
21
21b
21a
18
18a
60
14a
14
14c
14d
14b
17
13
10
23
2c
12
11
11a
24
25
21a
9
29
27
27c
29
27b
27c
27a
28
8
26a
26d
26
26c
26b

PRESSER-FOOT LIFTING AND LOWERING DEVICE FOR SEWING MACHINE

FIELD OF THE ART

The present invention relates to a presser-foot lifting and lowering device for sewing machine, particularly, when lifting and lowering a presser-foot by either of a manual operation lever and a knee operation lifter, the present invention relates to the presser-foot lifting and lowering device for sewing machine that a composition of a lifting and lowering mechanism can be simplified, the number of parts can be reduced and a production can be performed easily.

BACKGROUND OF THE ART

Conventionally, in the sewing machine, the presser-foot lifting and lowering device which lifts and lowers the presser-foot by either of the manual operation lever and the knee operation lifter is known (Patent document No. 1-No. 5).

PRIOR ART DOCUMENT

Patent Document

[Patent document No. 1] JU-H6-358-A
[Patent document No. 2] JP-H11-207066-A
[Patent document No. 3] JP-2003-326036-A
[Patent document No. 4] JP-2008-104496-A
[Patent document No. 5] JP-2010-11915-A

SUMMARY OF THE INVENTION

Problem to be Solved by the Invention

As for such the presser-foot lifting and lowering device for sewing machine, in the case that the presser-foot is lifted and lowered by the manual operation lever and in the case that the presser-foot is lifted and lowered by the knee operation lifter, each lifting and lowering mechanism is composed individually, and therefore, the mechanism is complicated, the number of parts is increased and the production is also complicated.

The present invention was conducted to solve these disadvantages. When lifting and lowering the presser-foot by either of the manual operation lever and the knee operation lifter, the object of the present invention is to provide the presser-foot lifting and lowering device for sewing machine that the composition of the lifting and lowering mechanism can be simplified, the number of parts can be reduced and the production can be performed easily.

Means for Solving the Problems

In order to achieve such the objects, in a presser-foot lifting and lowering device for sewing machine which lifts and lowers a presser-foot which is fixed at a slidable presser-foot bar in an arm head by either of a manual operation lever and a knee operation lifter for sandwiching a cloth which is sewed on a throat plate which is composed as one of a stitch forming device which is provided at an arm and a bed of a sewing machine and releasing the pressure, a presser-foot lifting and lowering device for sewing machine of the present invention has a lifter operating plate which is disposed at a pedestal which supports the arm on the bed and which is vertically movable depending on a vertical movement operation of the manual operation lever, a pivot rod whose one end is joined to the lifter operating plate through a first joining link, and a presser-foot bar lifting and lowering plate which is joined to a second joining link which is joined to the other end of the pivot rod and which is fixed firmly at the presser-foot bar and is joined to the presser-foot bar, and further has a knee lifter mechanism which has a knee lifter drive arm which is arranged at a right lower end of the bed and which attaches the knee operation lifter and rotates by the swing of the knee operation lifter, and the knee lifter drive arm is joined to the lifter operating plate.

In a presser-foot lifting and lowering device for sewing machine of the present invention, the pivot rod has a lifter height adjusting mechanism which has a movable pivoting point horizontally for adjusting a presser-foot lifting quantity of the presser-foot.

In a presser-foot lifting and lowering device for sewing machine of the present invention, a presser-foot pressure-adjusting device which has a presser-foot pressure-spring which is attached to an upper direction of a presser bar holder which is fixed firmly to the presser-foot bar, a presser-foot pressure-adjusting plate which repels elastically the presser-foot pressure-spring from an upper direction, a presser-foot pressure-adjusting cam which adjusts a vertical position of the presser-foot pressure-adjusting plate freely, a presser-foot pressure-adjusting knob for positioning in the rotation by the presser-foot pressure-adjusting cam, and a presser-foot pressure-adjusting shaft which transmits the rotation of the presser-foot pressure-adjusting knob to the presser-foot pressure-adjusting cam is provided.

Effect of the Invention

According to the presser-foot lifting and lowering device for sewing machine of the present invention, when lifting and lowering the presser-foot by either of the manual operation lever and the knee operation lifter, the composition of the lifting and lowering mechanism can be simplified, the number of parts can be reduced and the production can be performed easily.

Besides, according to the presser-foot lifting and lowering device for sewing machine of the present invention, a presser-foot lifting quantity of the presser-foot can be adjusted easily by a lifter height adjusting mechanism manually.

Besides, according to the presser-foot lifting and lowering device for sewing machine of the present invention, a pressure of the presser-foot can be adjusted easily by a pressure-adjusting device weakly or strongly.

BRIEF DESCRIPTION OF THE DRAWINGS

FIG. 3 A partial perspective view of the presser-foot mechanism in the presser-foot lifting and lowering device for sewing machine according to the present invention, (a) is a partially cutaway perspective view which is seeing from a left side of a front, and (b) is a partially cutaway perspective view which is seeing from a right side of a front.

MODE FOR CARRYING OUT THE INVENTION

Figure 1:
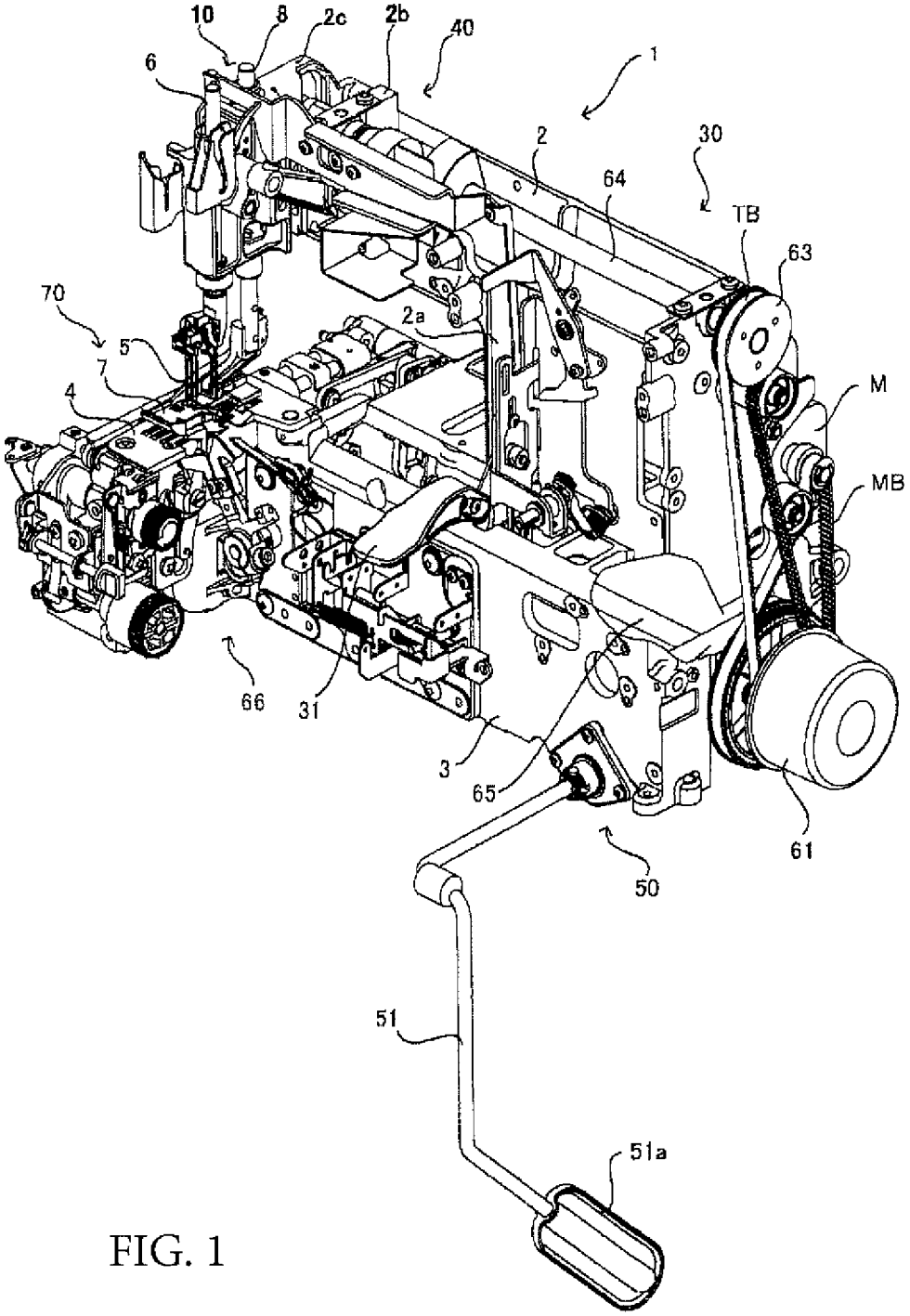
FIG. 1 A perspective view of a 5 needles 8 threads hemstitch overlock sewing machine (double chain stitch sewing machine) which applies the presser-foot lifting and lowering device for sewing machine according to the present invention.

Hereinafter, the preferable embodiment that the presser-foot lifting and lowering device for sewing machine according to the present invention is applied to a 5 (five) needles 8 (eight) threads hemstitch overlock sewing machine (double chain stitch sewing machine) is explained in detail by referring to the drawings.

As shown in FIG. 1, the overlock sewing machine 1 comprises a frame which forms an arm 2 and a bed 3.

A sewing machine motor M is attached to the frame and a lower shaft 65 extends horizontally along the bed 3 of the frame. The lower shaft 65 is rotated and driven by a motor belt MB by the sewing machine motor M. Besides, an upper shaft 64 extends horizontally along the arm 2, and is rotated and driven synchronously through a timing belt TB which is tensioned between an upper shaft timing pulley 63 which is fixed firmly at a rear end and a lower shaft timing pulley (not shown in the drawing) which is fixed firmly at a hand pulley 61 side of the lower shaft 65.

A stitch forming device 70 is formed by five needles 5 which are attached at an arm head 2*c* of the arm 2, fixed at a needle bar 6 which performs vertical motion in synchronization with the upper shaft 64 and performs vertical motion by piercing a throat plate 4, a needle drive mechanism which drives these needles 5, the presser-foot mechanism 10 including the presser-foot 7 which presses a cloth on the throat plate 4, a lower looper which traces the arc-like trajectory which intersects with the trajectory of the needles 5 at an underside of the throat plate 4 and reciprocates, and a double chain stitch looper, and an upper looper which traces the oval trajectory which intersects with the trajectory of the lower looper at the side of the throat plate 4 and intersects with the trajectory of the needles 5 at the upper side of the throat plate 4 and reciprocates (these loopers are shown with 66 as a whole), and a cloth feed mechanism which forwards the cloth every one stitch.

The upper looper, the lower looper and the double chain stitch looper are driven by a looper drive mechanism respectively. Although the needle drive mechanism of the stitch forming device 70 is driven by the upper shaft and the cloth feed mechanism and the looper drive mechanism are driven by the lower shaft, because the concrete structure and the motion are public known or well-known, the detailed explanation is omitted.

The presser-foot lifting and lowering device for sewing machine of the present invention lifts and lowers the presser-foot 7 which is fixed at a slidable presser-foot bar 8 vertically in the arm head 2*c* which is positioned at an arm front end 2*b* and fixed at the arm 2 by either of a manual operation lever 31 and a knee operation lifter 51 for sandwiching the cloth which is sewed on the throat plate 4 which is composed as one of the stitch forming device which is provided at the arm 2 and the bed 3 of the sewing machine 1 and releasing the pressure. In addition, the arm head 2*c* is fixed at the arm front end 2*b* in the arm 2 by screws 2*d* through positioning sleeves 2*e* (FIG. 3).

<Presser-Foot Mechanism>

Figure 2:
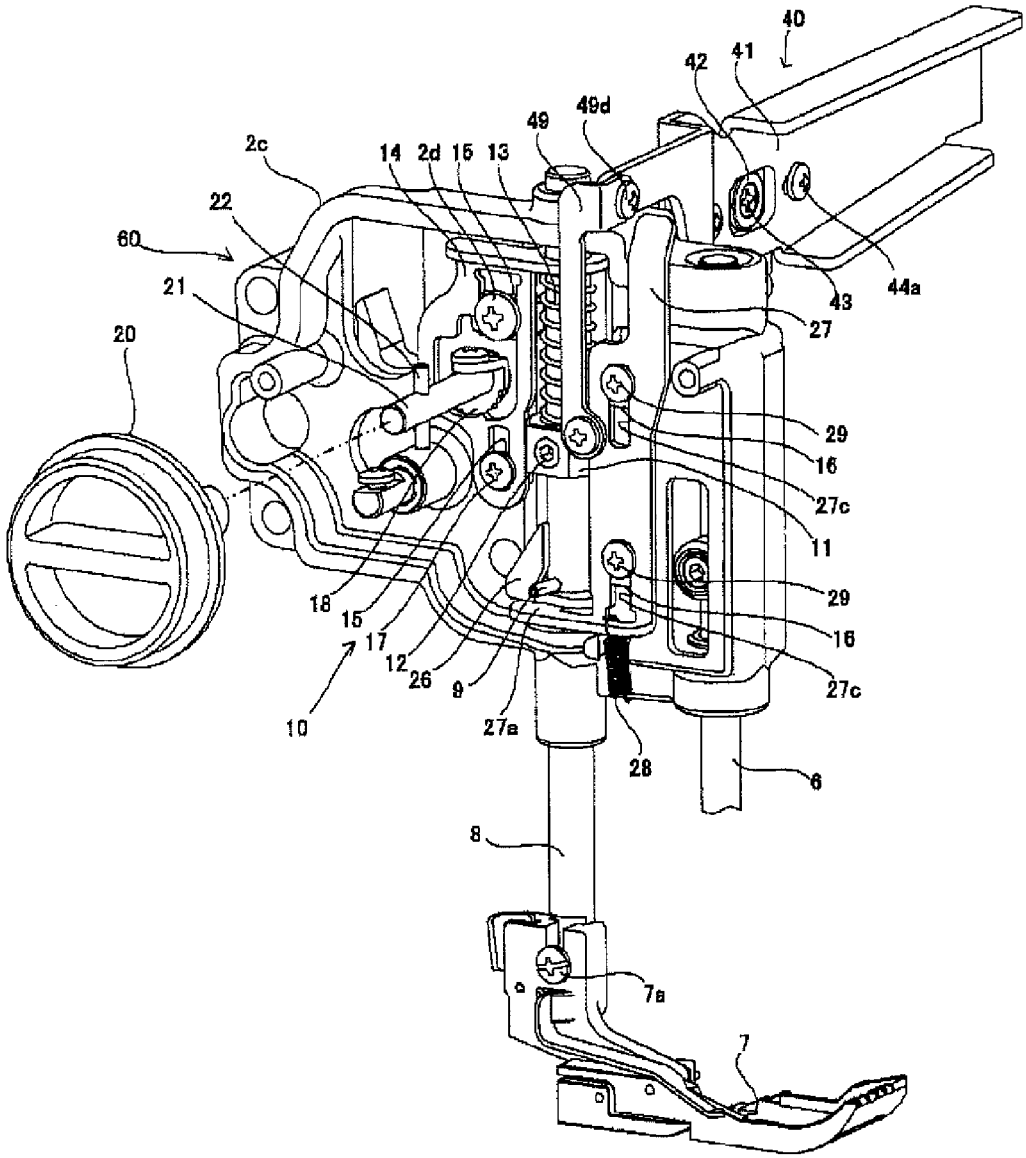
FIG. 2 A partial perspective view of a presser-foot pressure-adjusting device and a presser-foot mechanism in the presser-foot lifting and lowering device for sewing machine according to the present invention.
Figures 4A, 4B:
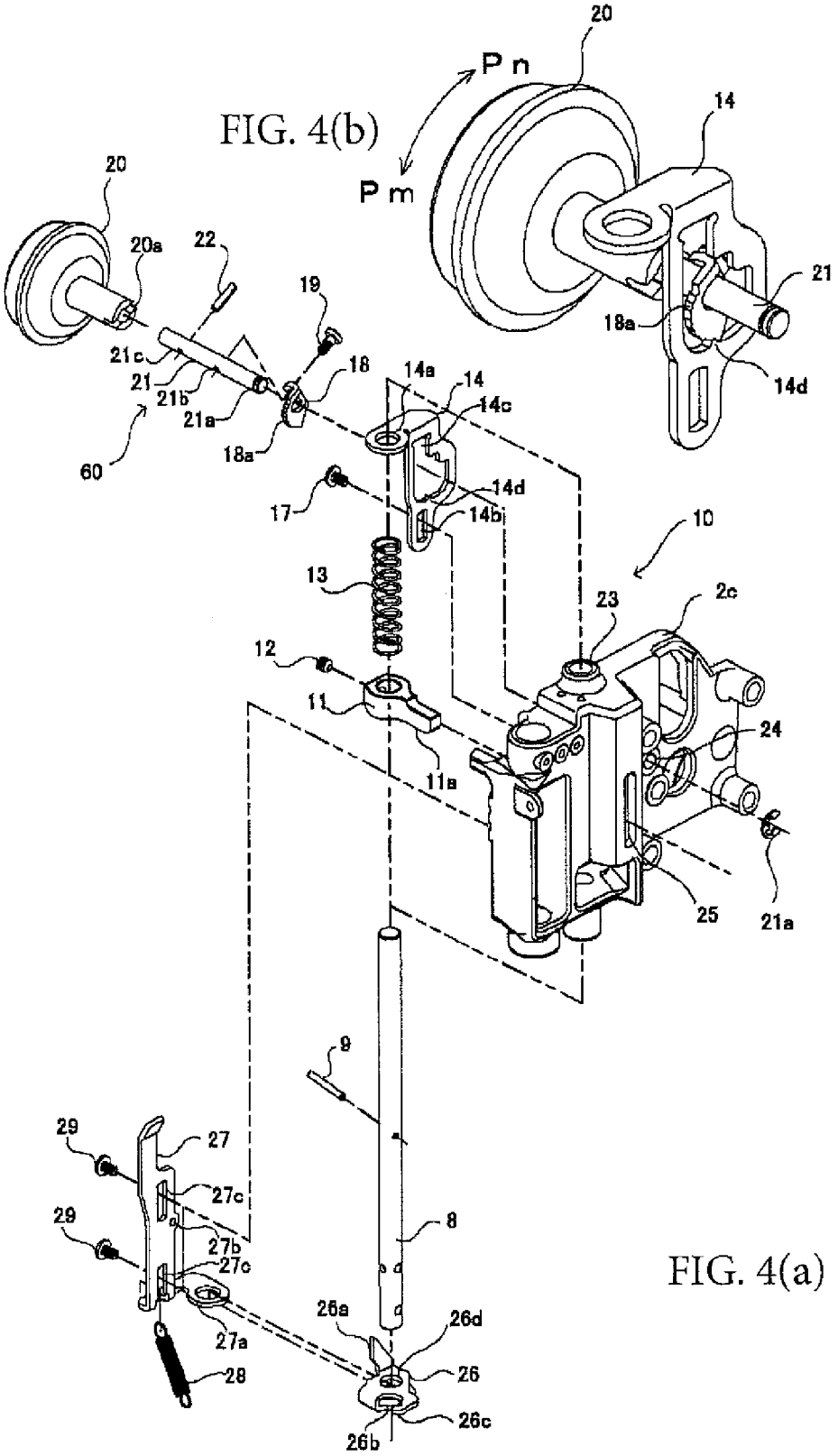
FIG. 4 An exploded perspective view of a presser-foot pressure-adjusting device and a presser-foot mechanism in the presser-foot lifting and lowering device for sewing machine according to the present invention, (a) is an exploded perspective view of the presser-foot pressure-adjusting device and the presser-foot mechanism which is seeing from a right side of a front, and (b) is a partial perspective view of the presser-foot pressure-adjusting device which is seeing from a right side of a front.
Figure 5A:
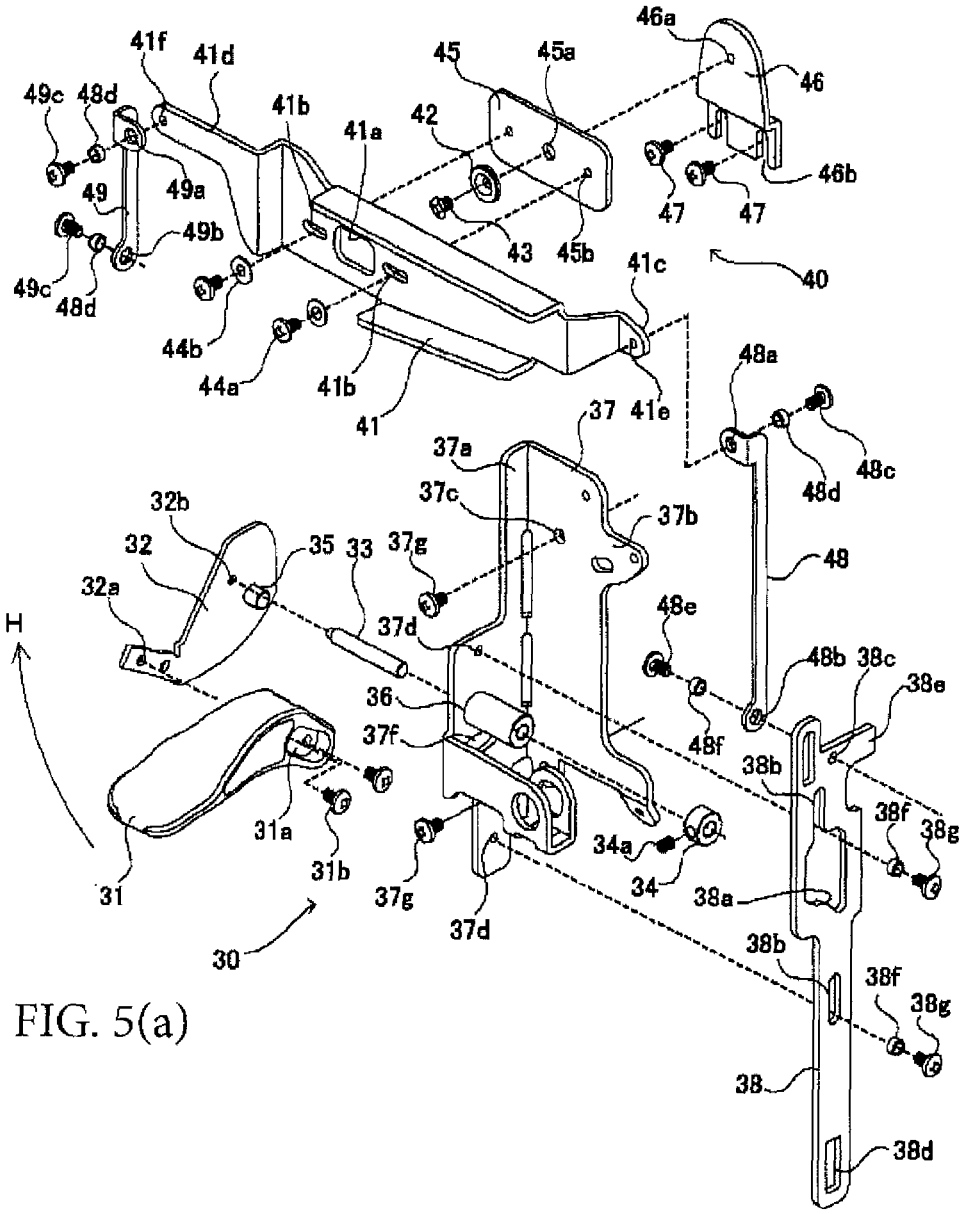
FIG. 5 An exploded perspective view of the presser-foot mechanism in the presser-foot lifting and lowering device for sewing machine according to the present invention, (a) is an exploded perspective view of a presser bar lifting and lowering mechanism and a lifter height adjusting mechanism, and (b) is a motion explanatory view of the lifter height adjusting mechanism.
Figure 5B:
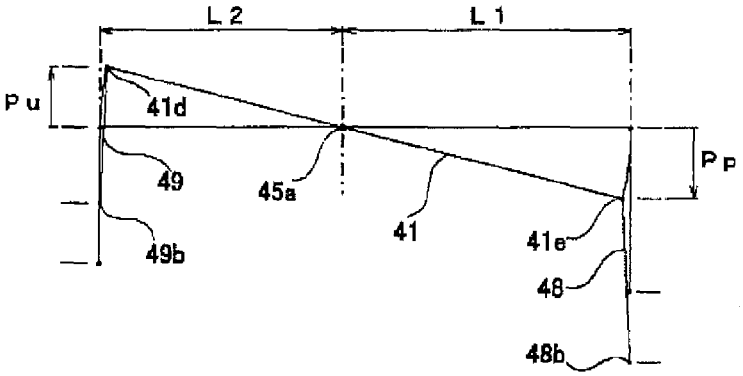

As shown in FIG. 1-FIG. 3 (*a*), (*b*), FIG. 4-FIG. 5 (*a*), (*b*), the presser-foot lifting and lowering device for sewing machine has the presser-foot mechanism 10 for pressing and releasing the cloth on the throat plate 4, and is composed by a presser bar lifting and lowering mechanism 30 and a knee lifter mechanism 50.

<Presser Bar Lifting and Lowering Mechanism>

In the presser-foot lifting and lowering device for sewing machine, the presser-foot mechanism 10 has the presser bar lifting and lowering mechanism 30.

The presser-foot 7 which performs the press and the release of the cloth by the presser-foot mechanism 10 has a presser-foot leg and a presser-foot part, and the presser-foot 7 is fixed swingably at the presser-foot bar 8 by a presser screw 7*a*.

The presser bar lifting and lowering mechanism 30 has a lifter operating plate 38 which is disposed at a pedestal 2*a* which supports the arm 2 on the bed 3 and which is vertically movable depending on a vertical movement operation of a manual operation lever 31, a pivot rod 41 whose one end is joined to the lifter operating plate 38 through a first joining link 48, and a presser-foot bar lifting and lowering plate 27 which is joined to a second joining link 49 which is joined to the other end of the pivot rod 41 and which is combined with a cloth thickness detector 26 which is joined to the presser-foot bar 8 through a presser-foot joining member 9 which is fixed firmly at the presser-foot bar 8.

A manual operation lever base 31*a* is screwed to a manual operation lever plate attaching portion 32*a* by a fastening screw 31*b*, and the manual operation lever 31 is attached to a manual operation lever plate 32. A manual operation lever plate shaft 33 which is fixed firmly to a manual operation lever plate shaft attaching hole 32*b* fits into a pivotal hole of a manual operation lever plate bearing 36 which is provided at a lifter mechanism attaching plate 37*a* of a lifter mechanism pedestal 37, and the manual operation lever plate 32 is positioned by a screw 34*a* of a thrust collar 34 and supported pivotally at the lifter mechanism pedestal 37.

In addition, the lifter mechanism pedestal 37 is fixed to a frame of the pedestal 2*a* by a lifter mechanism pedestal fixing hole 37*c* which is holed at a lifter mechanism pedestal plate 37*b* and an attaching screw 37*g*.

Besides, a lifter pin 35 is fixed firmly to the manual operation lever plate 32, and is swingable at an arc-like lifter pin hole 37*f* of the lifter mechanism pedestal 37 because the manual operation lever plate bearing 36 becomes a pivoting point, and the lifter pin 35 touches to a lifter cam 38*a* of the lifter operating plate 38, and the lifter operating plate 38 is movable vertically depending on a vertical movement operation of the manual operation lever 31, therefore depending on a swing of the lifter pin 35. A fastening screw 38*g* is screwed to a lifter operating plate pivotal hole 37*d* through a lifter operating plate slide receiver 38*f* from an elongate hole shaped lifter operating plate slide hole 38*b* of the lifter operating plate 38, and the lifter operating plate 38 is slidable vertically by the guide of the lifter operating plate slide receiver 38*f*.

A lifter link joining hole 38*c* is screwed to a lifter operating plate joining end 48*b* by a screw 48*e* through a receiver 48*f*, and the lifter operating plate 38 is joined to the first joining link 48.

A drive rod joining end 48*a* is screwed to a joining screw hole 41*e* by a screw 48*c* through a receiver 48*d*, and the first joining link 48 is joined to a lifter mechanism joining arm 41*c* of the pivot rod 41 in the lifter height adjusting mechanism 40.

<Lifter Height Adjusting Mechanism>

As for the pivot rod 41 in the lifter height adjusting mechanism 40, a pivot shaft attaching screw 43 is screwed to a pivot rod attaching hole 46*a* of a pivot rod fulcrum plate base 46*b* of a pivot rod fulcrum plate 46 through a pivot rod shaft 42 and through a pivot rod adjusting square hole 41*a* and a pivot rod receiving plate pivotal hole 45*a* of a pivot rod receiving plate 45.

The pivot rod fulcrum plate 46 is fixed to the frame of the arm 2 by a fulcrum plate attaching hole 46*b* and a fastening screw 47. In this way, a pivot rod fastening screw 44*a* is screwed to a fixing screw hole 45*b* of the pivot rod receiving plate 45 through a washer 44*b* and through a pivot rod adjusting elongate hole 41*b*, and the pivot rod 41 is slidable in a horizontal direction, that is, in a transverse direction by loosening the pivot rod fastening screw 44*a*.

A joining screw hole 41*f* and a link joining hole 49*a* are screwed by a screw 49*c* through the receiver 48*d* in a presser-foot mechanism joining arm 41*d*, and the pivot rod 41 is joined to the second joining link 49.

A link joining hole 49*b* is screwed to the presser-foot bar lifting and lowering plate 27 by the fastening screw 49*c* through the receiver 48*d*, and the second joining link 49 is joined to the presser-foot bar lifting and lowering plate 27.

A fastening screw 29 is screwed to a presser-foot bar lifting and lowering plate slide convex part 16 which is provided at the arm head 2*c* from a presser-foot bar lifting and lowering plate slide elongate hole 27*c*, and the presser-foot bar lifting and lowering plate 27 is guided between the fastening screw 29 and the presser-foot bar lifting and lowering plate slide convex part 16, and is slidable along the presser-foot bar lifting and lowering plate slide elongate hole 27*c* vertically.

A presser-foot bar lifting and lowering plate spring 28 is intervened between the presser-foot bar lifting and lowering plate 27 and the arm head 2*c*, and the presser-foot bar lifting and lowering plate 27 is always repelled elastically to a lower direction.

In the presser-foot bar lifting and lowering plate 27, a presser-foot bar lifting and lowering plate joining part 27*a* is fitted loosely and joined to a holding part 26*b* of the cloth thickness detector 26 which engages to the presser-foot joining member 9 which is fixed firmly to the presser-foot bar 8 from a lower direction, and the presser-foot joining member 9, therefore the presser-foot 7 is lifted and lowered depending on the lifting and lowering of the presser-foot bar lifting and lowering plate 27.

<Presser-Foot Pressure-Adjusting Device>

In the presser-foot lifting and lowering device for sewing machine according to the present invention, a presser-foot pressure-adjusting device 60 is attached to the arm head 2*c* (FIG. 2, FIG. 4).

The presser-foot pressure-adjusting device 60 has a presser-foot pressure-spring 13 which is attached to an upper direction of a presser bar holder 11 which is fixed firmly to the presser-foot bar 8, a presser-foot pressure-adjusting plate 14 which repels elastically the presser-foot pressure-spring 13 from an upper direction, a presser-foot pressure-adjusting cam 18 which adjusts a vertical position of the presser-foot pressure-adjusting plate 14 freely, a presser-foot pressure-adjusting knob 20 which is positioned in the rotation by the presser-foot pressure-adjusting cam 18, and a presser-foot pressure-adjusting shaft 21 which transmits the rotation of the presser-foot pressure-adjusting knob 20 to the presser-foot pressure-adjusting cam 18.

The presser-foot pressure-adjusting shaft 21 fits into a pivotal hole 24 of the arm head 2*c* rotatably, and the presser-foot pressure-adjusting shaft 21 is positioned in a shaft direction by the presser-foot pressure-adjusting cam 18 that one end is fixed firmly at an intermediate portion of an E ring 21*a* and the presser-foot pressure-adjusting shaft 21 by a screw 19. The presser-foot pressure-adjusting cam 18 has latching teeth 18*a*, and the presser-foot pressure-adjusting plate 14 has a positioning protrusion 14*d* which engages to the latching teeth 18*a*. The latching teeth 18*a* and the positioning protrusion 14*d* are engaged depending on the rotation of the presser-foot pressure-adjusting knob 20 and the position in the rotation is decided, and a position of height of the presser-foot pressure-adjusting plate 14 is adjusted (FIG. 4 (*b*)).

The presser-foot bar 8 is attached to a presser bar pivotal hole 23 of the arm head 2*c* slidably in a vertical direction. The presser-foot pressure-spring 13 is fixed to the presser-foot pressure-adjusting plate 14 and intervenes round the presser-foot bar 8 between an upper part of the presser-foot pressure-adjusting plate 14 which is fitted to the presser-foot bar 8 at a presser-foot pressure-adjusting plate hole 14*a* and the presser bar holder 11.

A rotation stop part 11*a* of the presser bar holder 11 is attached to a presser-foot positioning groove 25 of the arm head 2*c* slidably and stops the rotation of the presser-foot bar 8 slidably in a vertical direction.

The screws 2*d* and a screw 17 which position the arm head 2*c* in the arm front end 2*b* are screwed to presser-foot pressure-adjusting plate slide convex parts 15 which is provided at the arm head 2*c* from presser-foot pressure-adjusting plate elongate holes 14*c*, 14*b* respectively, and the presser-foot pressure-adjusting plate 14 is guided between the screws 2*d*, the screw 17 and the presser-foot pressure-adjusting plate slide convex parts 15 and is slidable along the presser-foot pressure-adjusting plate elongate holes 14*c*, 14*b* in the vertical direction.

The presser-foot bar lifting and lowering plate 27 supports the cloth thickness detector 26 (FIG. 2, FIG. 4) which is attached to the presser-foot bar 8 slidably. A cloth thickness detecting member 26*a* which slants for a shaft line of the presser-foot bar 8 is formed at the cloth thickness detector 26. The presser-foot joining member 9 which is implanted to the presser-foot bar 8 is engaged with the cloth thickness detecting member 26*a*. A cloth thickness responding member 26*c* which is fitted to the presser-foot bar 8 loosely and is rotatable around the presser-foot bar 8 is formed at the cloth thickness detector 26. The cloth thickness responding member 26*c* is joined to a thread supply device (not shown in the drawing) which supplies needle threads every one stitch depending on the cloth thickness by a wire.

The presser-foot bar 8 performs the vertical motion depending on the cloth thickness, and therefore the presser-foot joining member 9 performs the vertical motion, and the cloth thickness detecting member 26*a* of the cloth thickness detector 26 moves for the shaft line of the presser-foot bar 8 in the transverse direction, and the cloth thickness responding member 26*c* rotates, and the response of the detection of the cloth thickness is performed. The thread supply device is controlled by the response of the detection of the cloth thickness correspondingly, and the needle threads are supplied to the needles 5 every one stitch depending on the cloth thickness.

According to the presser-foot lifting and lowering device for sewing machine which is composed in this way, by the presser bar lifting and lowering mechanism 30 of the presser-foot mechanism 10, when now lifting the manual operation lever 31 to the H direction by the manual operation, the presser-foot joining member 9, therefore the presser-foot 7 ascends depending on the swing of the manual operation lever plate 32, the descent ($P_L$ direction) of the lifter operating plate 38, the descent of the first joining link 48, the swing of the pivot rod 41, the ascent of the second joining link 49 and the presser-foot bar lifting and lowering plate 27. Therefore, the presser-foot 7 can be lifted independently by the manual operation of the manual operation lever 31 and the presser-foot 7 separates from the cloth. In addition, when releasing the manual operation of the manual operation lever 31, the sewing becomes possible by sandwiching the cloth on the throat plate 4 and pressing the cloth by the presser-foot 7 by the elastic repulsion of the presser-foot pressure-spring 13. In this way, the presser-foot 7 can be lifted and lowered independently by the manual operation of the manual operation lever 31.

Besides, according to the presser-foot lifting and lowering device for sewing machine, in the lifter height adjusting mechanism 40 which is built into the presser bar lifting and lowering mechanism 30, by a pivot rod receiving plate pivotal hole in the pivot rod 41 according to the first joining link 48 and the second joining link 49, that is, by the pivoting point 45*a*, a lifter mechanism joining arm length L1 and a presser-foot mechanism joining arm length L2 become variable, and by loosening a position adjusting screw 44*a* of the pivot rod 41 which is fixed firmly to the pivot rod receiving plate 45, and by comparing the variation of the position of the link joining hole 41*f*, that is, the presser-foot lifting quantity Pu of the presser-foot 7 and the variation of the position of the lifter operating plate joining end 48*b*, that is, a lifter operating length Pp, the adjustment can be performed manually (FIG. 5 (*b*)).

Further, in the case of this presser-foot lifting and lowering, when rotating the presser-foot pressure-adjusting knob 20 to Pm direction and Pn direction, the presser-foot pressure-adjusting cam 18 engages to the presser-foot pressure-adjusting cam protrusion 14*d* of the presser-foot pressure-adjusting plate 14 by the rotation of the presser-foot pressure-adjusting shaft 21, and the presser-foot pressure-adjusting plate 14 performs vertical motion, and the elasticity of the presser-foot pressure-spring 13, therefore the pressure of the presser-foot 7 can be adjusted weakly or strongly (FIG. 4).

Besides, the presser-foot bar lifting and lowering plate 27 does not affect to the thread supply device by lifting and lowering integrally with the cloth thickness detector 26 by either of the operation of the manual operation lever 31 and the knee operation lifter 51 in the presser bar lifting and lowering mechanism 30 and the knee lifter mechanism 50 of the presser-foot mechanism 10. However, a thread tension loosening protrusion 38*e* (FIG. 5) of the lifter operating plate 38 affects to the thread supply device and the needle threads are released and loosened, and the drawing of the needle threads before and after sewing operation becomes possible.

<Knee Lifter Mechanism>

Figure 6A:
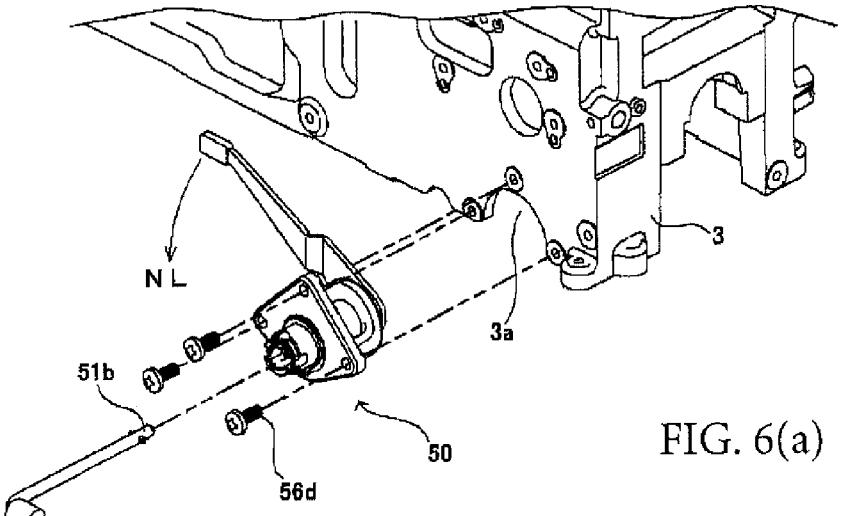
FIG. 6 A knee lifter mechanism is shown in the presser-foot lifting and lowering device for sewing machine according to the present invention, (a) is a perspective view of the knee lifter mechanism, and (b) is an exploded perspective view of the knee lifter mechanism.
Figure 6B:
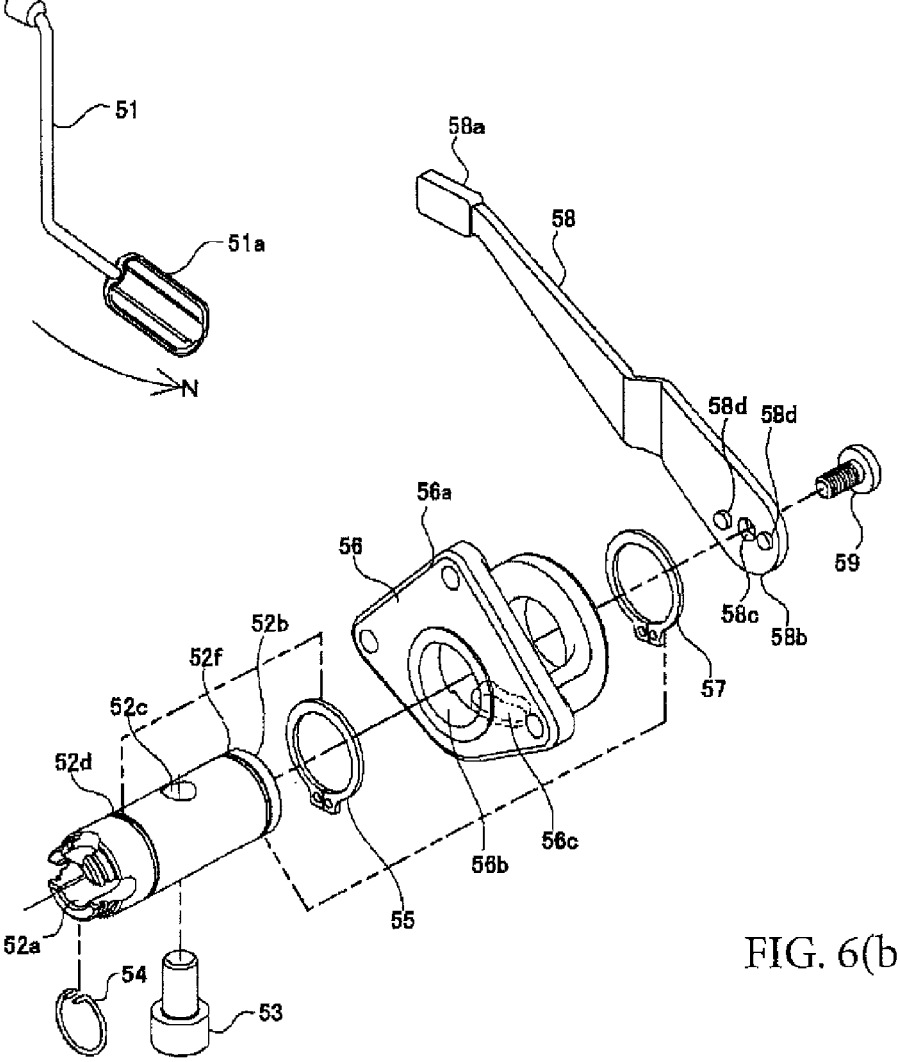

Besides, in addition to above composition, as shown in FIG. 1, FIG. 6 (*a*), (*b*), the presser-foot lifting and lowering device for sewing machine of the present invention has the knee lifter mechanism 50 in the presser-foot mechanism 10.

The knee lifter mechanism 50 has a knee lifter drive arm 58 which is arranged at a knee lifter mechanism attaching portion of the bed 3, that is, arranged at a right lower end 3*a* and which attaches the knee operation lifter 51 and rotates by the swing of the knee operation lifter 51.

The knee operation lifter 51 has a shape which is shown in the drawing and has a knee pad 51*a*. The knee operation lifter 51 can be attached to a knee operation lifter shaft 52 by a fixing ring 54 manually.

The knee operation lifter shaft 52 is fitted into a knee operation lifter shaft pivotal hole 56*b* of a bearing attaching portion 56*a* in a knee operation lifter bearing 56, and is attached pivotally by C shaped rings 55, 57 rotatably while inhibiting the movement of the shaft direction. The knee operation lifter bearing 56 is fixed to the knee lifter mechanism attaching portion of the bed 3, that is, fixed to the right lower end 3*a* by fastening screws 56*d*. A knee lifter stopper hole 56*c* that a swing restriction pin 53 is fixed firmly to a joining hole 52*c* of the knee operation lifter shaft 52 which is fitted into the knee operation lifter shaft pivotal hole 56*b* and a tip of the swing restriction pin engages and restricts the swing of the direction of the rotation is provided at the knee operation lifter bearing 56. The knee lifter drive arm 58 is provided at one end 52*b* of the knee operation lifter shaft 52. A knee lifter drive arm attaching portion 58*b* of the knee lifter drive arm 58 is fitted into a concave part (not shown in the drawing) of the knee operation lifter shaft 52 which corresponds to knee lifter drive arm positioning protrusions 58*d*, and is joined to the knee operation lifter shaft 52 through a knee lifter drive arm attaching hole 58*c* by a fastening screw 59.

The knee lifter drive arm 58 is fitted into a knee lifter device joining hole 38*d* of the above lifter operating plate 38 by that knee lifter drive end 58*a* and is joined.

According to the presser-foot lifting and lowering device for sewing machine which is composed in this way, by the knee lifter mechanism 50 of the presser-foot mechanism 10, when now moving the knee pad 51*a* of the knee operation lifter 51 to a right outer direction N by a knee operation of a sewing machine operator, the knee lifter drive arm 58 swings to a counterclockwise direction NL, and the lifter operating plate 38 descends by the knee lifter drive end 58*a*. As ascent to H direction is performed by the manual operation of the above manual operation lever 31, the presser-foot joining member 9, therefore the presser-foot 7 ascends depending on the descent of the lifter operating plate 38 and the first joining link 48, the swing of the pivot rod 41, the ascent of the second joining link 49 and the presser-foot bar lifting and lowering plate 27. In addition, when releasing the knee operation to the knee pad 51*a* of the knee operation lifter 51, the sewing becomes possible by sandwiching the cloth on the throat plate 4 and pressing the cloth by the presser-foot 7 by the elastic repulsion of the presser-foot pressure-spring 13. In this way, the vertical motion of the lifter operating plate 38 is performed by the swing of the knee lifter drive arm 58, and the presser-foot can be lifted and lowered independently by the knee operation of the knee operation lifter.

In this case, because the knee lifter mechanism 50 of the presser-foot mechanism 10 shares the lifter operating plate 38, the first joining link 48, the pivot rod 41, the second joining link 49 and the presser-foot bar lifting and lowering plate 27 in the presser bar lifting and lowering mechanism 30, the composition of the lifting and lowering device can be simplified, the number of parts can be reduced and the production can be performed easily.

In the above embodiment, although the presser-foot lifting and lowering device for sewing machine according to the present invention is explained in the mode example which is applied to the overlock sewing machine (double chain stitch sewing machine), this presser-foot lifting and lowering device can be applied to a lock stitch sewing machine or other sewing machine equally.

INDUSTRIAL APPLICABILITY

The presser-foot lifting and lowering device for sewing machine in the present invention is possible to apply suitably to all sewing machines which need the presser-foot and is useful in the industry.

EXPLANATION OF THE NUMERALS

1 sewing machine
2 arm
2*a* pedestal
2*c* arm head
3 bed
3*a* right lower end
4 throat plate
5 needle
6 needle bar
7 presser-foot
8 presser-foot bar
10 presser-foot mechanism
11 presser bar holder
13 presser-foot pressure-spring
14 presser-foot pressure-adjusting plate
18 presser-foot pressure-adjusting cam
20 presser-foot pressure-adjusting knob
21 presser-foot pressure-adjusting shaft
27 presser-foot bar lifting and lowering plate
30 presser bar lifting and lowering mechanism
31 manual operation lever
38 lifter operating plate
40 lifter height adjusting mechanism
48 first joining link
41 pivot rod
45*a* pivot rod receiving plate pivotal hole (pivoting point)
49 second joining link
50 knee lifter mechanism
51 knee operation lifter
58 knee lifter drive arm
60 presser-foot pressure-adjusting device
Pu presser-foot lifting quantity

The invention claimed is:

1. A presser-foot lifting and lowering device for sewing machine which lifts and lowers a presser-foot which is fixed at a slidable presser-foot bar in an arm head by either of a manual operation lever and a knee operation lifter for sandwiching a cloth which is sewed on a throat plate which is composed as one of a stitch forming device which is provided at an arm and a bed of a sewing machine and releasing the pressure, comprising:

a presser bar lifting and lowering mechanism having a lifter operating plate which is disposed at a pedestal which supports said arm on said bed and which is vertically movable depending on a vertical movement operation of said manual operation lever, a pivot rod whose one end is joined to said lifter operating plate through a first joining link, and a presser-foot bar lifting and lowering plate which is joined to a second joining link which is joined to the other end of said pivot rod and which is fixed firmly at said presser-foot bar and is joined to said presser-foot bar, and further comprising:

a knee lifter mechanism which has a knee lifter drive arm which is arranged at a right lower end of said bed and which attaches said knee operation lifter and rotates by the swing of said knee operation lifter, wherein said knee lifter drive arm is joined to said lifter operating plate.

2. A presser-foot lifting and lowering device for sewing machine according to claim 1, wherein:

said pivot rod has a lifter height adjusting mechanism having a movable pivoting point horizontally for adjusting a presser-foot lifting quantity of said presser-foot.

3. A presser-foot lifting and lowering device for sewing machine according to claim 1, comprising:

a pressure-adjusting device having a presser-foot pressure-spring which is attached to an upper direction of said a presser bar holder which is fixed firmly to said presser-foot bar, a presser-foot pressure-adjusting plate which repels elastically said presser-foot pressure-spring from an upper direction, a pressure adjusting cam which adjusts a vertical position of said presser-foot pressure-adjusting plate freely, a presser-foot pressure-adjusting knob for positioning in the rotation by said presser-foot pressure-adjusting cam, and a presser-foot pressure-adjusting shaft which transmits the rotation of said presser-foot pressure-adjusting knob to said presser-foot pressure-adjusting cam.

* * * * *